US005687530A

United States Patent [19]

Van der Heijden

[11] Patent Number: 5,687,530

[45] Date of Patent: Nov. 18, 1997

[54] COMPOSITE BUILDING UNIT

[76] Inventor: Franciscus Anthonius Maria Van der Heijden, Kastelenplein 73, NL-5653 LP Eindhoven, Netherlands

[21] Appl. No.: 443,287

[22] Filed: May 17, 1995

[30] Foreign Application Priority Data

May 18, 1994 [NL] Netherlands ..... 9400813

[51] Int. Cl.[6] ..... E04B 2/32

[52] U.S. Cl. ..... 52/592.6; 52/284; 52/561; 52/565; 52/569

[58] Field of Search ..... 52/563, 564, 565, 52/568, 569, 561, 571, 574, 592.6, 592.2, 309.15, 270, 284, 309.9, 309.14

[56] References Cited

U.S. PATENT DOCUMENTS

| | | | |
|---|---|---|---|
| 2,194,047 | 3/1940 | Markle | 52/563 X |
| 2,647,392 | 8/1953 | Wilson | 52/563 |
| 3,855,751 | 12/1974 | Struthers | 52/284 X |
| 4,107,894 | 8/1978 | Mullins | 52/592.6 |
| 4,142,338 | 3/1979 | Becker | 52/173 |
| 4,787,189 | 11/1988 | Haug et al. | 52/415 |

FOREIGN PATENT DOCUMENTS

| | | | |
|---|---|---|---|
| 8425671 | 9/1984 | Australia | 52/561 |
| 2508956 | 1/1983 | France | 52/561 |
| 2113741 | 8/1983 | United Kingdom | 52/561 |

*Primary Examiner*—Wynn E. Wood
*Assistant Examiner*—Timothy B. Kang
*Attorney, Agent, or Firm*—Titus McConomy LLP

[57] ABSTRACT

A composite building unit comprising at least one volume element having an upper surface with at least one projection and a bottom surface with at least one cavity positioned and configured to accommodate a projection from another volume element and at least one support element positioned between said upper and bottom surface of said volume element.

16 Claims, 13 Drawing Sheets

COMPOSITE BUILDING UNIT

FIELD OF THE INVENTION

The invention relates to a substantially rectangular interlockable composite building unit, and, in particular, to building unit which is made up of a pair of volume elements and a support element interposed therebetween, and using a coupling element for connecting units together.

BACKGROUND OF THE INVENTION

Generally, building units such as the type described hereinafter are better known in the toy industry where they are used to make miniature buildings for play. Individual interlockable building units are not generally known to the building industry for making modular buildings. Modular construction normally has involved large units comprising entire rooms or sections of buildings which have been manufactured at a location remote from the construction site and thereafter transported thereto. While the manufacture of these modular units in a factory has certain benefits, much of the advantage is lost in transportation and the size of the individual modules.

Interlocking blocks, on the other hand, have been used in construction, but their primary field of use has been in paving applications. Concrete or composite materials and foamed materials such as polyurethane have been used to form small building units for residential construction, but have not found wide general application. Those building units which have been proposed have had difficulty satisfying a number of competing requirements such as resistance against tensile and pressure forces while providing thermal and acoustic isolation. In the past it has been difficult to combine all these characteristics into the same building unit. There are materials which can be used to provide the combination of these characteristics, but they have the common disadvantage that they are expensive.

It is therefore an object of the invention to provide a building unit whereby the disadvantages cited above can be avoided. It is a further objective of the invention to provide a building unit which facilitates construction and can be produced in a cost effective manner. A yet further objective is to provide a building unit which is manufactured in a factory, but can be easily transported to the construction site to be assembled by a worker of average skill.

SUMMARY OF THE INVENTION

Generally, the present invention provides a composite building unit which includes at least one volume element and a support element. In a preferred embodiment two volume elements which are adapted to mate one to the other with a support element interposed therebetween. The support element is generally of a conforming configuration to the volume element, but includes on opposing sides a protuberance and recess, respectively, to assist in interconnectability of the respective building units.

Additionally, the invention includes coupling elements which are adapted to couple or interlock the volume elements together to form walls or other types of partitions. The coupling elements are also used to mount decorating panels or architectural panels over the volume elements.

By utilizing various elements for the building unit it is possible to select materials therefor in such a manner that the required characteristics can be achieved. For example, where a pair of mating volume elements have interposed a support element, each element can be of a different material such as steel for the support element to provide strength and various different plastics for the two volume elements to provide insulation or fire protection or the like. Other characteristics and advantages will become clear from a perusal of the following description of presently preferred embodiments of the invention taken in connection with the accompanying drawings.

PRESENTLY PREFERRED EMBODIMENTS

Figure 1:
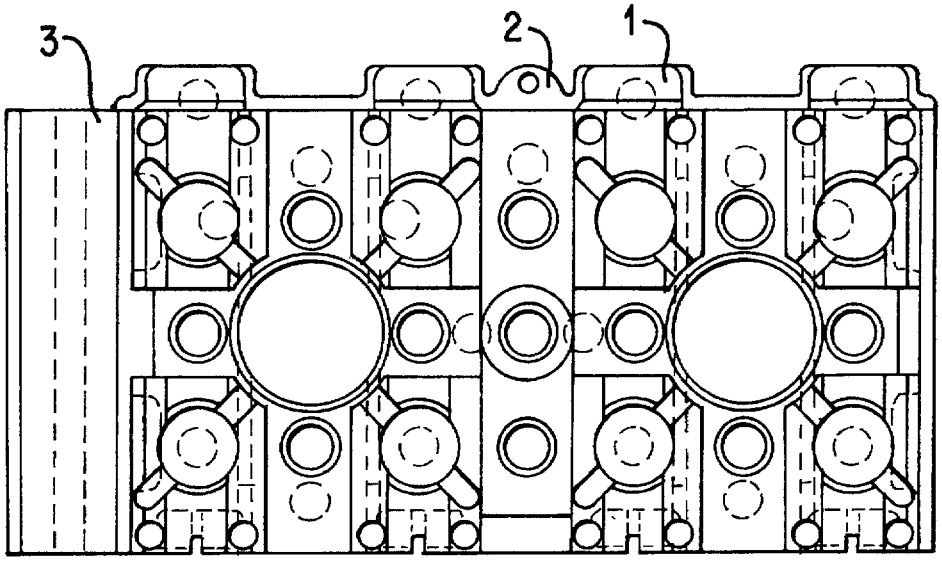
FIG. 1 a side view of a building unit according to the invention.
Figure 25:
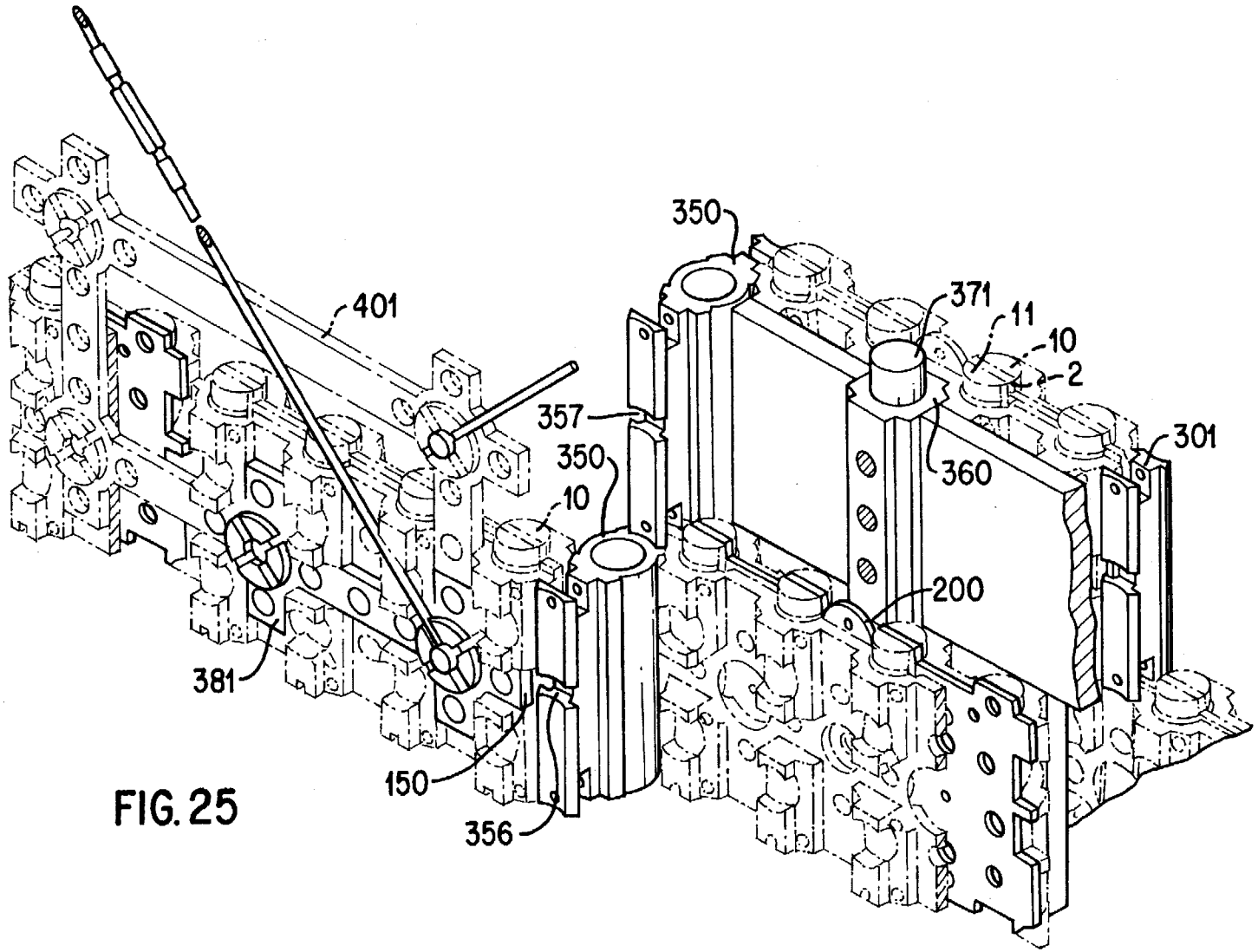
FIG. 25 a perspective view of a composition showing how the different elements, volume element, support element, coupling element and reinforcing element and connecting element are composed in order to form a modular building unit.

Referring to FIG. 1, the building unit of the present invention is shown in its most basic form. As shown in FIG. 1, the building unit is composed of a volume element 1, a support element 2 positioned behind volume element 1, and a coupling element 3 attached to volume element 1 and support element 2. In this embodiment, (as shown in FIG. 25), the building unit comprises two volume elements 10 and 11, which are identical and positioned back-to-back with respect to each other in mirror-symmetry. Support element 2 is interposed between elements 10 and 11.

Referring to FIGS. 2–6, volume element 10 is shown in greater detail. Volume element 10 has a substantially rectangular shape and is preferably made out of a material with a low specific weight. Other characteristics of the material can be chosen in relation to the design characteristics of the final building such as durability, thermal insulation, strength and wind shears, and floor loadings.

Suitable materials can be selected from the group of polystyrene, polyethylene, polypropylene, polyacrylates, polyvinylchloride, polyvinyl acetate, polyvinylalcohol, polyester (PET or PBT), alkyd resins, poly-urethanes, acrylate resins, polyesters resins, amine resins, phenyl resins and epoxy resins either foamed or not. In these materials filling agents can be applied such as fibers, whether or not of an inert nature. Other suitable materials could be gas injected concrete, blown clay, straw cement, fibrous cement and pressed glass wool and/or stone wool impregnated with resin.

Figure 2:
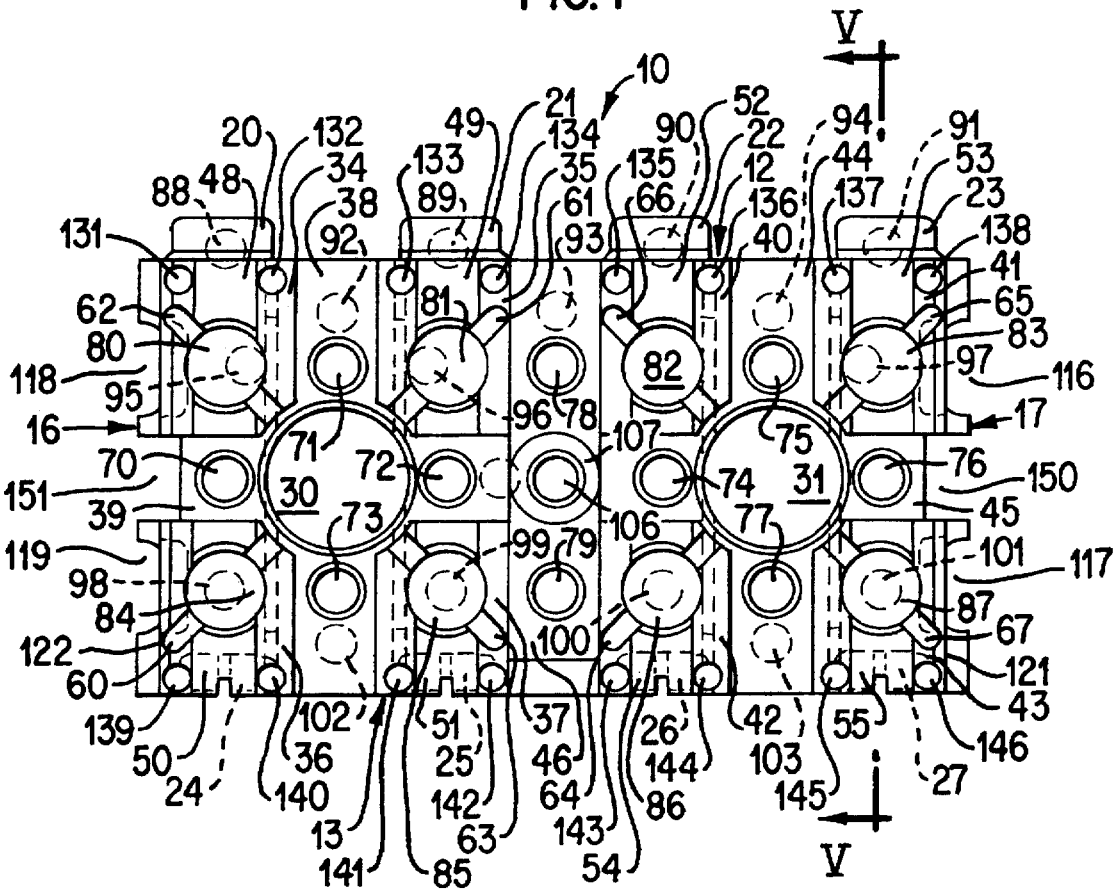
FIG. 2 a side view of a volume element used in the building unit according to FIG. 1.
Figure 3:
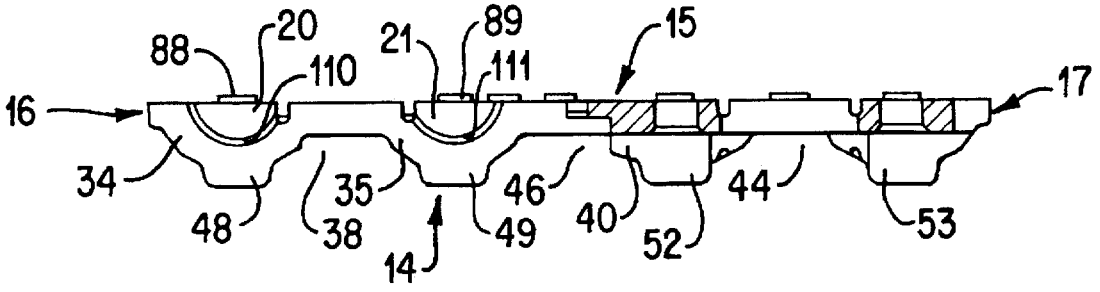
FIG. 3 a top view partly in section of the volume element shown in FIG. 2.

For a better understanding of the volume element, the six faces shown in FIGS. 2 and 3 are nominated as follows: upper surface 12, bottom surface 13, longitudinal or outer surface 14, abutting or inner surface 15 and cross surfaces 16 and 17, it being understood that these names are not to be construed as restricting the use of a building unit in a construction. The connecting edges between the upper surface and bottom surface on the one hand and the inner and outer surface on the other hand are named longitudinal edges, whereas the connecting edges between the upper surface and bottom surface on the one hand and the cross surfaces on the other hand are named cross edges and the four remaining edges are called upright edges.

In the construction shown in FIG. 2 the volume element 10 has an upper surface 12 provided with four projections 20, 21, 22 and 23 extending perpendicular from the upper surface 12 and having a semi-circular cross-section. The projections 20–23 are regularly spaced along a line parallel to the longitudinal edges. In the bottom surface of the volume element 10 there are provided four cavities 24, 25, 26 and 27 having a form corresponding to the form of the projections 20–23, in such a way that the projections 20-23 of a similar volume element can be accommodated completely in these cavities.

The distances, hereinafter call stitch, between the projections 20 and 21 is equal to the distance between the projections 21 and 22 etc. The distance between the projection 20 and the cross surface 16 and between the projection 23 and the cross surface 17 may be equal to half the distance or stitch between the projections 20 and 21, but in FIG. 2 this distance is smaller so that when two volume elements are placed side by side with their cross surfaces facing and after introducing a coupling element 3, the distance between the neighboring projections on the two volume elements is equal to the stitch.

Perpendicular to the outer surface 14 there are provided two bores 30 and 31, the bore 30 being located in the middle between the projections 20 and 21 and the bore 31 in the middle between the projections 22 and 23. Moreover the bores 30 and 31 are located in the middle between the upper surface 12 and the bottom surface 13. Around the bore 30 and on the outer surface 14 there are provided four "structural support members, hereinafter referred to as kams". 34, 35, 36 and 37 in such a way that two grooves 38 and 39 are formed intersecting each other under an angle of 90°. The groove 38 extends in a direction perpendicular to the upper surface in the middle between the projections 20 and 21, and the groove 39 extends in a direction parallel to the longitudinal edges. Each kam 34, 35, 36 and 37 has as seen in the direction perpendicular to the outer surface 14 a rectangular shape, the corner portion located close to the bore 30 being removed, in such a way that an edge is formed concentrically to the bore 30. In the same way there are four kams 40, 41, 42 and 43 around the bore 31, with grooves 44 and 45, the groove 45 extending in the extension of the groove 39. In this way there is provided a groove 46 between the kams 35 and 40 and 37 and 42, which is parallel to the grooves 38 and 44.

Figure 4:
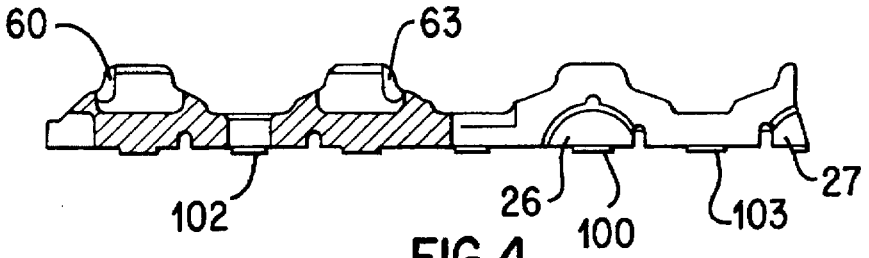
FIG. 4 a bottom view, partly in cross-section of the volume element shown in FIG. 2.
Figure 5:
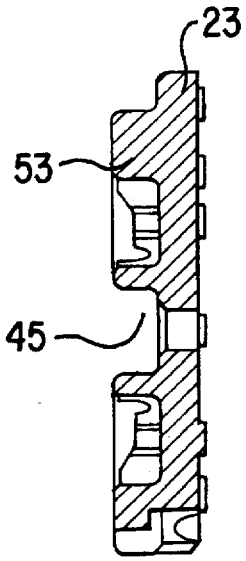
FIG. 5 a cross section according to the line V—V of the volume element shown in FIG. 2.
Figure 6:
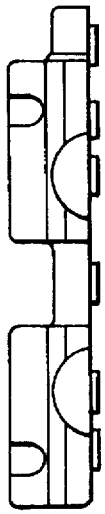
FIG. 6 a side view of the volume element shown in FIG. 2.
Figure 8:
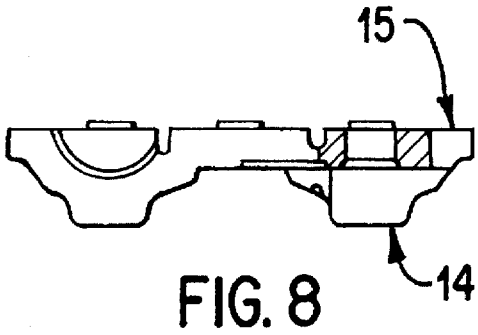
FIGS. 7–10 a representation in accordance with FIGS. 2–5 of a modified construction of a volume element.
Figure 7:
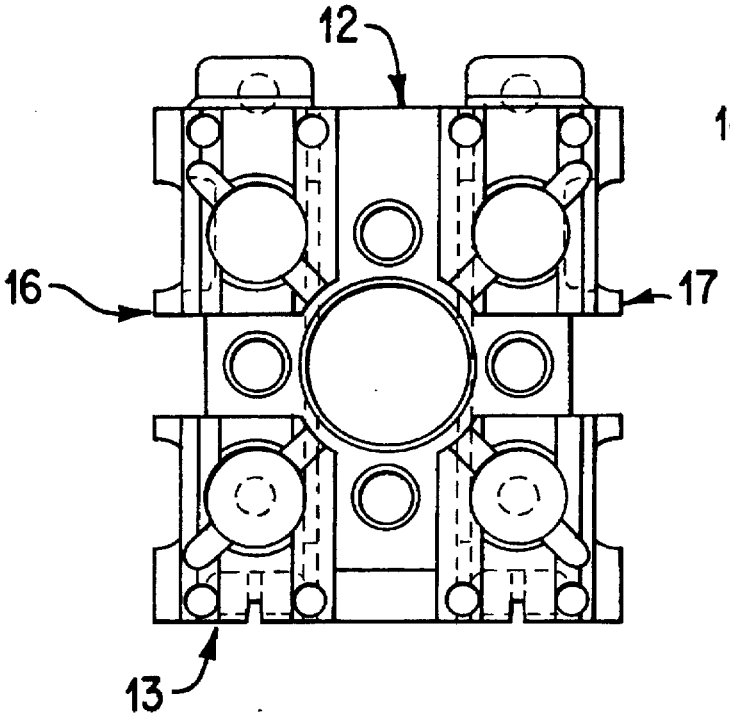
Figure 10:
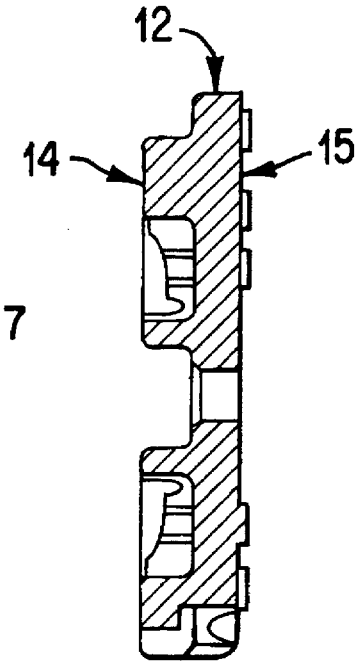
Figure 9:
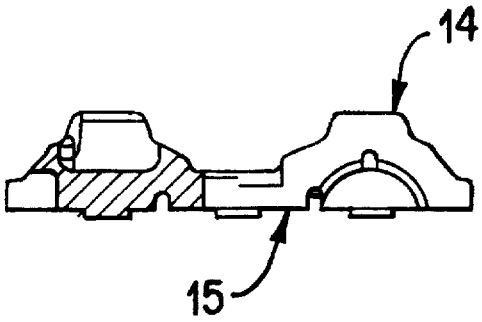

Upon each of the kams 34–37 and 40–43 there is provided a second kam 48–55. These cams 48–55 have as seen in the direction of the cross edges the shape of a rectangle, the long edge of which being parallel to the upright edges. In the direction of the longitudinal surfaces these rectangular kams 48–55 are located centrally with respect to the cams 34–37 and 40–43. The edges of the cams 34–37 and 40–43 which are parallel to the longitudinal edges are beveled as shown in FIGS. 3 and 4. In this way the grooves 38, 44 and 46 have a cross section limited by two wand portions having a direction perpendicular to the outer surface 14 and a wall portion which is oblique with respect to the outer surface 14. The grooves 38, 44 and 46 have an identical cross section.

In each kam 34–37 and 40–43 there is provided a cylindrical hole 80–87, having an axis perpendicular of the outer surface 14 of the volume element. The diameter of the holes 80–87 is substantially equal to the diameter of the projections 20–23.

The holes 80–83 and 84–87 respectively are located on one line parallel to the longitudinal edges, whereas the pairs of holes 80, 84; 81, 85; 82, 86 and 83, 87 are located on one line parallel to the upright edges. The distance between two neighboring holes on the same line is equal to the stitch.

Grooves with U-shaped cross-section 60 and 61 extend through the kams 35 and 36, in such a way that the axis of the grooves 60 and 61 respectively extend through the center of the holes 81 and 84 respectively. The grooves 60 and 61 are in each other's prolongation. In the same way there are grooves 62 and 63 in the kams 34 and 36, grooves 64 and 65 in the kams 42 and 41 and grooves 66 and 67 in the kams 40 and 43.

Around the bores 30 and 31 and located in the grooves 39, 38, 39, 38 and 45, 44, 45, 44 respectively there are bores 70, 71, 72, 73 and 74, 75, 76, 77 respectively extending perpendicular to the outer surface 14. In groove 46 two corresponding bores 78, 79 are provided, bore 79 being located on the same line with the bores 71, 75, and the bore 78 being located on the same line with bores 73, 77.

The tangent plane 15 of the volume element is provided with a number of grooves 110, 111, 112, 113 having substantially a semi-circular cross-section and extending from the upper surface 12 to the bottom surface 13. The grooves 110–113 are parallel to each other and to the upright edges and are located in line with the projections 20–23 respectively. A number of kams 88–103 is provided on the tangent plane 15, which kams in the construction shown in FIG. 2 have a semi-circular cross-section, but other shapes or forms can be used as well.

The kams 88–130 are positioned in such a way that when two volume elements are positioned with respect to each other that their tangent planes 15 are facing each other and covering each other, the kams of the first volume element are abutting the kams of the second volume element.

The dimensions of the cams 88–103 in the direction perpendicular to the tangent plane 15 are chosen in such a way that when two volume elements are positioned as described, the grooves 110–113 of the first volume element and the grooves 113–110 of the second volume element together form a cylindrical channel. The diameter of these channels is equal to the diameter of the bores 70–79.

It is also possible to locate the kams 88–103 in such a way on the tangent plane that when the two volume elements are positioned together with their tangent plane facing each other and covering each other, the kams of the one volume element are located beside the kams of the other volume element. The dimension of the kams in the direction perpendicular to the tangent plane 15 must then be chosen in such a way that the same effect with respect to the cylindrical channels is obtained.

In each cross surface of the volume element 10 there are provided two semi-circular holes 116, 117 and 118, 119 respectively. When two volume parts 10 are positioned side by side with their tangent planes 15 touching each other, the holes 116, 118 and 117, 119 form two circular holes with dimensions corresponding to the holes 80–87.

Close to the cross surfaces 16 and 17 there are provided stepped edges 121 and 122 formed by the edges of the projections 41, 43 and 34, 36 respectively. If two volume parts are positioned side by side with their tangent planes touching each other, then the distance between the outer surfaces, in that case defined by the bottom of the grooves 38, 39, 44, 45 and 46 is equal to the width of the grooves. The same applies for the parts 125, 126 between the stepped edges 121,122 and the cross surfaces.

If needed semicircular grooves can be made in the tangent plane at the location of the grooves 38 and 44, which semicircular grooves correspond to the grooves 110–113 with respect to their dimensions and orientation. Furthermore and as shown in FIG. 2 a bore 106 may be provided centrally with respect to the bores 72, 74, 78 and 79, the end of the bore 106 directed towards the outer surface being provided with a cylindrical hole 107 having a diameter corresponding to the diameter of the cavities 24–27 and 80–87 respectively.

As shown in FIG. 2, a number of bores 131–146 are made in the projections 34, 37 and 40–43, each time two in each projection and located at both sides of the projections 48–55, the bores 131–138 being positioned close to the upper surface 12 and the bores 139–141 close to the bottom surface. The diameter of the bores 131-146 is substantially equal to the width of the grooves 60–67.

The support element according to the invention can have the shape of cylindrical bars, having a diameter equal to the inner diameter of the substantially cylindrical grooves 110–113 which are formed when two volume parts are placed side by side with their tangent planes 15 facing and covering each other. These bars are preferably made of a material with a sufficient resistance against stretch and pressure. Suitable materials are e.g. wood, metals such as steel, aluminum, plastic especially with fibers reinforces plastics. The length of these bars may be equal to the distance between the bottom and upper surface. Alternatively the length of the bars may be a multiple of this distance.

The same type of bars but with adapted length may be used as connecting element. This applies to the connection of two volume parts to form one volume element as to the connection of two volume elements placed side by side, in which case the bars extend through the bores 70–79 and 106. The diameters of the bores 70–79 and 106 and the diameter of the bars can be chosen in such a way that a press fitting is obtained. This effect can also be obtained by a suitable selection of the material of the volume part so that an elastic deformation is obtained.

Figure 11:
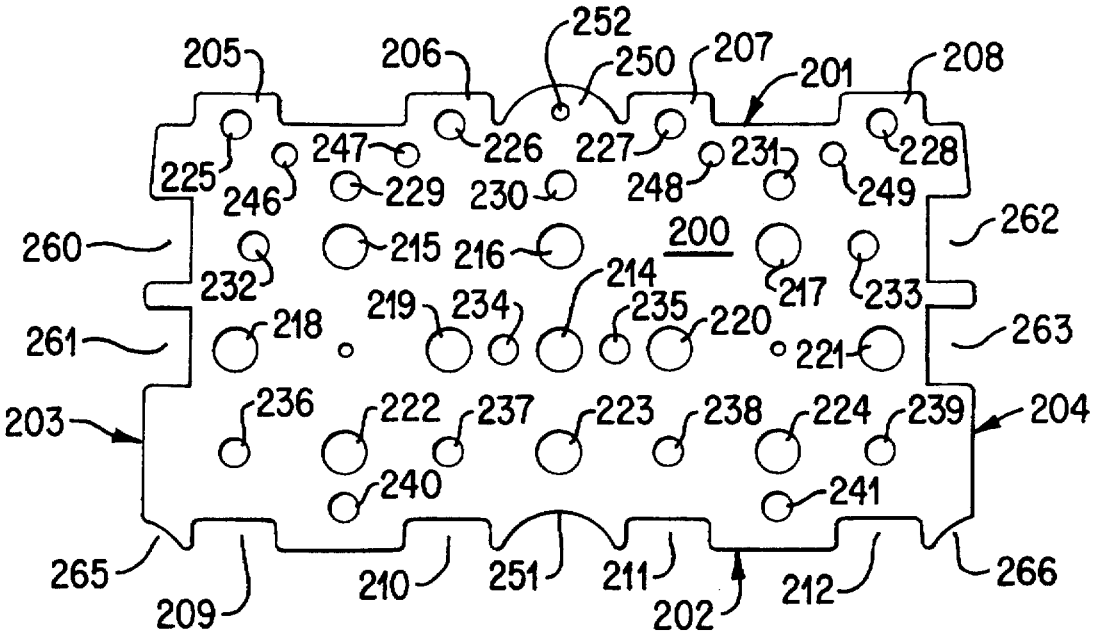
FIG. 11 a representation of a support element which can be combined with the volume element according to FIGS. 2–6.

Another form of the support element is shown in FIG. 11. This support element comprises a substantially rectangular plate 200 made of suitable material, such as described with respect to the cylindrical bars to be used as support elements. The plate 200 has a thickness defined in relation to the required strength and corresponding to the height of the kams 88–103 on the tangent plane 15 of the volume element 10. The following description is restricted to the two dimensions perpendicular to the thickness of the plate 200. The plate 200 has an upper surface 201, a bottom surface 202 and two cross surfaces 203 and 204, the words upper, bottom and cross having the same meaning as used with respect to the description of the volume element 10, at least in so far that the terminology is consistent in the relative position of the different portions after assembling the volume parts and the support elements. The dimension of the plate 200 corresponds to the dimensions of the tangent plane 15 of the volume part.

The upper edge 201 is provided with four projections 205–208, corresponding to the projections 20–23 of the volume part. In the same way the bottom edge is provided with recesses 209–212 corresponding to the cavities 24–27 in the bottom surface of the volume part.

The support element 200 is further provided with bores 214–224 corresponding to the bores 70–79 and 106 in the volume part. Furthermore a number of bores 225–241 is provided suitable for accommodating the kams 88–103 on the tangent plane 15 of the volume element 10, 11. At last there are provided bores 246–249 corresponding to the bores 132, 133, 136 and 137 in the volume part. It is however clear that more bores can be provided, e.g. corresponding to all bores 131–146 in the volume element 10.

The upper edge 201 is centrally provided with a protruding portion 250 with a circular edge, whereas the bottom edge 202 is provided with a corresponding recess 251. In the protruding portion 250 a bore 252 is provided. When the support element 250 is placed between two volume parts, the protruding portion 250 will extend above the upper surface of the volume parts. The function of the protruding portion 250 with bore 252 will be described later.

Each cross surface 203 and 204 is provided with two rectangular recesses 260, 261 and 262, 263 respectively, having all the same dimensions. The recesses 260 and 262 are located in such a way that in a composition comprising two volume parts and a support element, the recesses 260 and 262 coincide with the recesses 116, 118 in the volume parts.

The function of the recesses 261,263 will be described later.

The corners 265,266 at the junction of the cross surfaces 203, 204 with the bottom surface 202 have such a configuration that two support elements positioned side by side, each cross surface 203 facing cross surface 203, form together with their corners 265 and 266 a recess corresponding to the recess 251.

Figure 12:
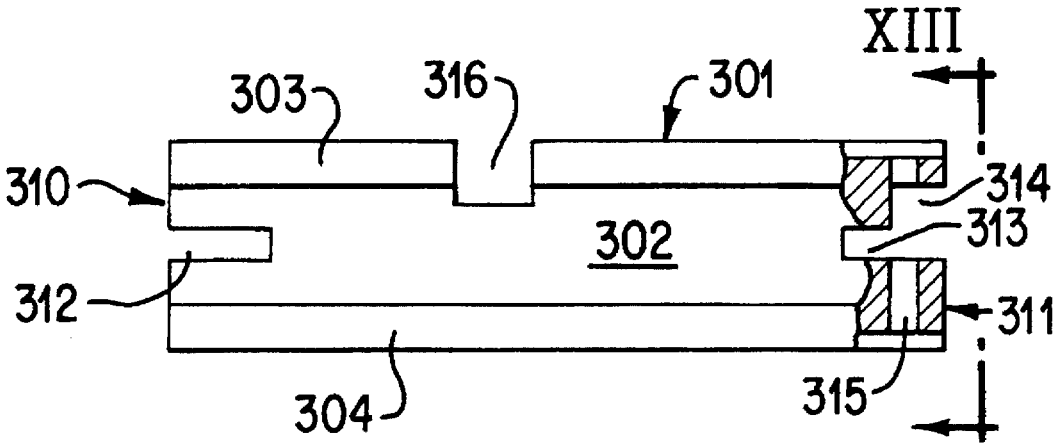
FIG. 12 a representation, partly in side view partly in cross section of a coupling element which can be combined with the building unit according to the invention.
Figure 13:
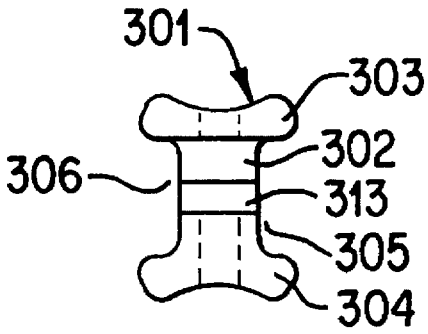
FIG. 13 a side view in the direction of the arrow XIII of the coupling element according to FIG. 12.

The coupling element 301 shown in FIG. 12 and 13 serves to connect a cross surface 16 or 17 of a volume part with the cross surface 17 or 16 respectively of a neighboring volume part.

The coupling element 301 has the shape of a profile with a length corresponding substantially to the height of the volume element 10. The profile has a cross section as shown in FIG. 13 and comprises a central portion 302 with rectangular cross section. To the surface corresponding to the shorter edges a plate-like member 303 and 304 respectively has been applied, extending at both sides such that two grooves 305 and 306 are formed. The surface of the portions 303 and 304 not touching the part 302 has the shape of a circularly bent concave surface, the diameter of the circularly bent portion being equal to the diameter of the projections 20–23. The width of the grooves 306 and 305 correspond to the width of the kams 48–55 of the volume element 10 and also to the width of the grooves 38, 39, 44, 45 and 46.

Each end face 310, 311 of the coupling element is provided with a groove 312 and 313 respectively. In the end face 311 there is provided an additional recess 314, having a smaller depth than the groove 313 which recess extends from the groove 313 until the border surface between the central portion 302 and the plane portion 303.

A bore 315 extends over the complete thickness of the coupling element 301 in a direction perpendicular to the groove 313, the bore 315 being located approximately halfway the depth of the groove 313. To the side part of the plate like member 303 the coupling element 301 is provided with a rectangular recess 316. As measured from the end face 310, the distance until the first edge of the recess 316 is equal to the distance from the upper surface 12 until the nearest edge of the groove 39 or 45. The width of the recess 316 is equal to half the width of the groove 44.

Figure 14:
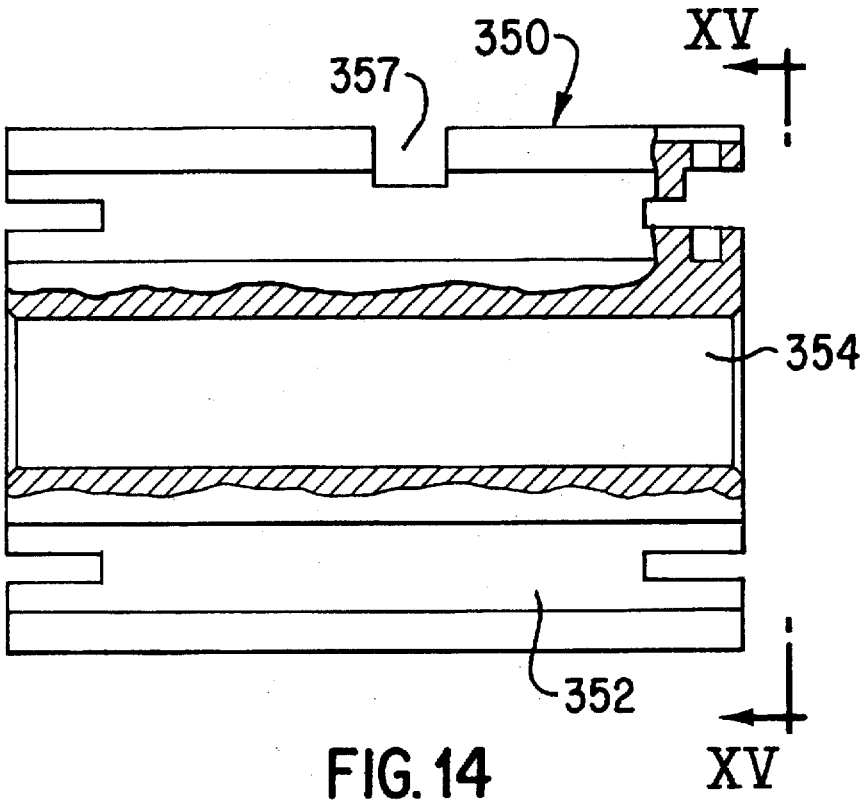
FIG. 14 a representation, partly in side view partly in cross section of a coupling element modified with respect to the one shown in FIGS. 12 and 13.
Figure 15:
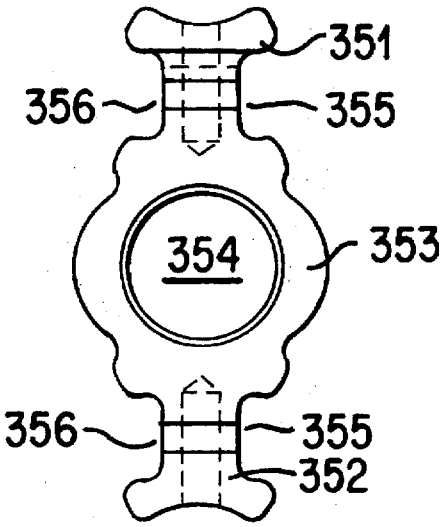
FIG. 15 a side view in the direction of the arrow XV of the coupling element according to FIG. 14.

The coupling element 350 shown in FIG. 14 and 15 cannot only be used for coupling one cross surface 16/17 of a volume part with a cross surface 16/17 of an adjacent volume part, but can also be used for coupling two volume parts having their outer surfaces placed in parallel to each other.

The coupling element 350 has the shape of a profile with a length which is substantially equal to the height of the volume element. The profile has a cross section as shown in FIG. 15 and can be described as having two portions 351 and 352 interconnected by a central portion 353. The shape of the central portion 353 is chosen in such a way that when the coupling element is positioned against the outer surface 14 of a volume element 10, two adjacent projections 48–55 are matching with the grooves 355 and 356 in the portions 351 and 352. The distance between the portions is such that the central portion 353 fits in the intermediate groove 38, 44, 46 in the outer surface 14 and extending over its entire length a bore 354 is provided having a diameter corresponding with the diameter of the recesses 24–27.

Furthermore, the width of the grooves 355 and 356 in the portions 351 and 352 is adapted to accommodate cross surfaces 16 or 17 of two volume parts 10, 11 positioned with their tangent planes 15 against each other, so that by means of the coupling element 350 two volume elements 1 can be positioned parallel to each other. The mutual fixation can be done in different ways and will be discussed later.

Figure 16:
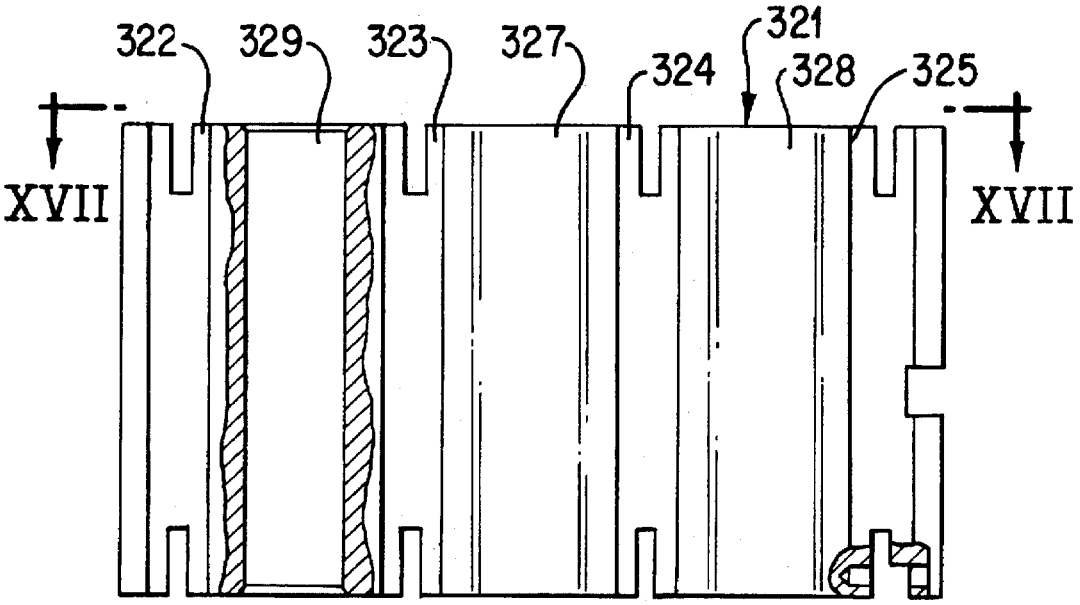
FIG. 16 a representation, partly in side view partly in cross section of a coupling element modified with respect to the one shown in FIGS. 12 and 14.
Figure 17:
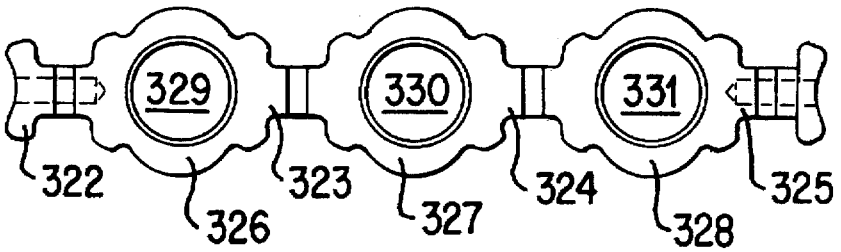
FIG. 17 a view in the direction of the arrow XVII of the coupling element according to FIG. 16.

In the FIGS. 16 and 17, there is shown a third construction of a coupling element 321. Actually the coupling element 321 is composed of four parts 322–325 corresponding to the coupling element 301. The four parts 322–325 are two by two coupled together by means of central pans 326–328, corresponding to the central part 353 of the coupling element 350, and provided with bores 329–331. By means of the coupling element 321 at most four volume elements can be positioned in a parallel relationship to each other. But it is also possible to position two volume elements on a parallel relationship but at a distance from each other. The coupling element 350 as well as the coupling element 321 can be used to interconnect the cross surfaces of two volume elements located in line with each other. Moreover, it is possible to position the volume elements in a stepped relation with respect to each other.

Figure 18:
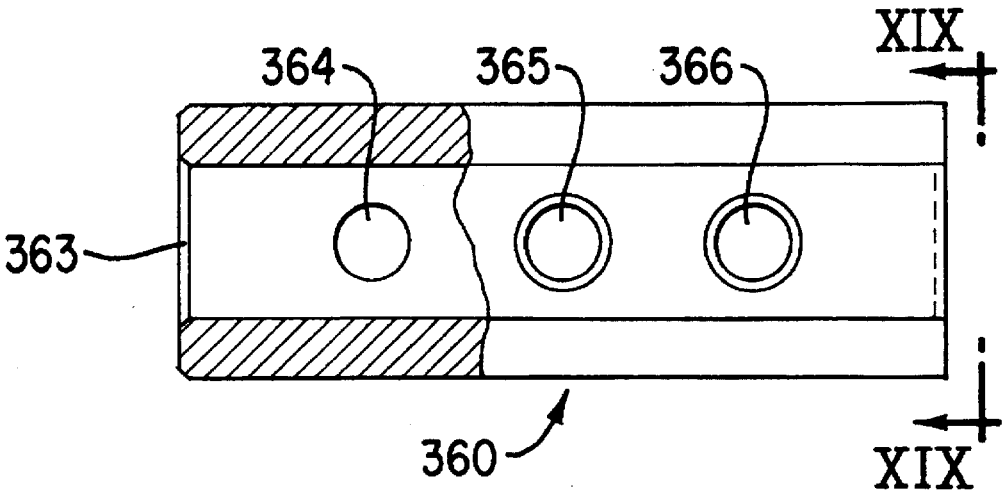
FIG. 18 a representation, partly in side view partly in cross section of a coupling element modified with respect to the one shown in FIGS. 12, 13 and 14.
Figure 19:
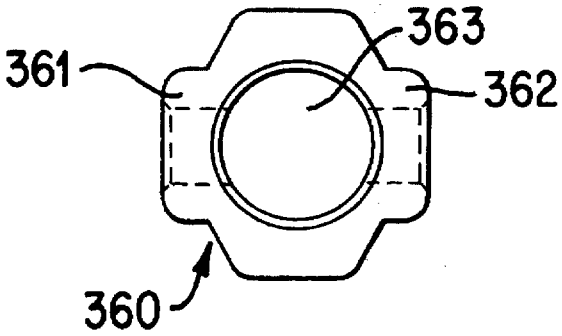
FIG. 19 a view on the direction of the arrow XIX of the coupling element of FIG. 18.

A modified construction of the coupling element is shown in FIG. 18 and 19. This coupling element 360 consists of a part corresponding to the central portion 353 in the coupling element 350. Actually the coupling element 360 is adapted to connect two volume elements through their outer surfaces, ribs 361 and 362 provided on the coupling element 360 being able to be accommodated in one of the grooves 38, 44 or 46. Furthermore, the coupling element 360 is provided with a longitudinal bore 363, suitable for different purposes such as the accommodation of a cylindrical support element perpendicular to the longitudinal bore 363 and extending from one rib 311 to another rib 312 there are provided three bores 364,365 and 366, corresponding to the bores 78, 79 and 106 in the volume element. These bores are thus suitable for the accommodation of a cylindrical coupling element.

Figure 20:
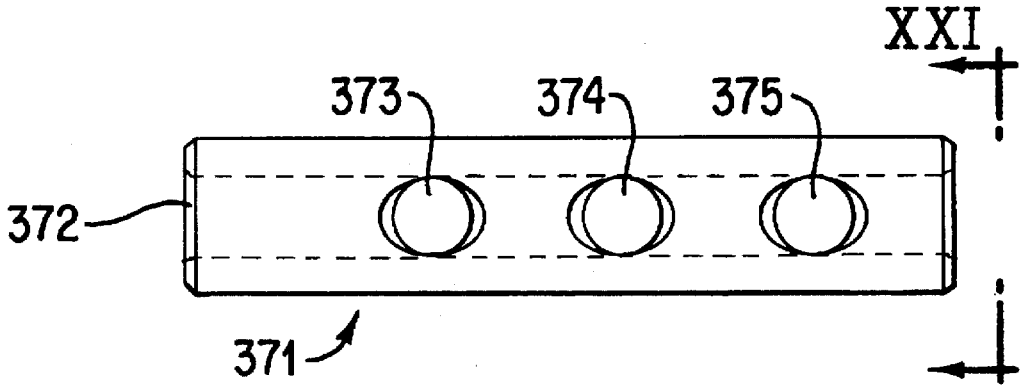
FIG. 20 a representation of a reinforcing element of the coupling element according to the invention.
Figure 21:
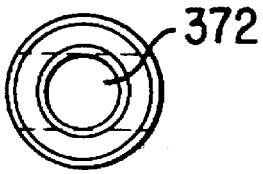
FIG. 21 a view in the direction of the arrow XXI of the reinforcing element according to FIG. 20.

In FIGS. 20 and 21 there is shown a support element 371 suitable to be brought into the longitudinal bore 363 of the coupling element 360, or in the longitudinal bores 354 of the coupling elements 350 or the longitudinal bores 329, 330, 331 of the coupling elements 321 respectively. The support element 371 consists of a cylindrical pipe with a central longitudinal bore 372 and perpendicular thereto provided with three cross bores 373, 374 and 375. The longitudinal bore 372 has a diameter which is equal to the diameter of e.g., the bore 71 in the volume part. The bores 373, 374 and 375 correspond to e.g., the bores 78, 106 and 79 in the volume part, so that therein cylindrical connections can be provided.

Different volume elements positioned side by side can be fixed with respect to each other by means of pull bars. In order to connect two volume elements located with their outer surface in the same plane, connecting elements can be used which are further connected to each other as described below.

Figure 22:
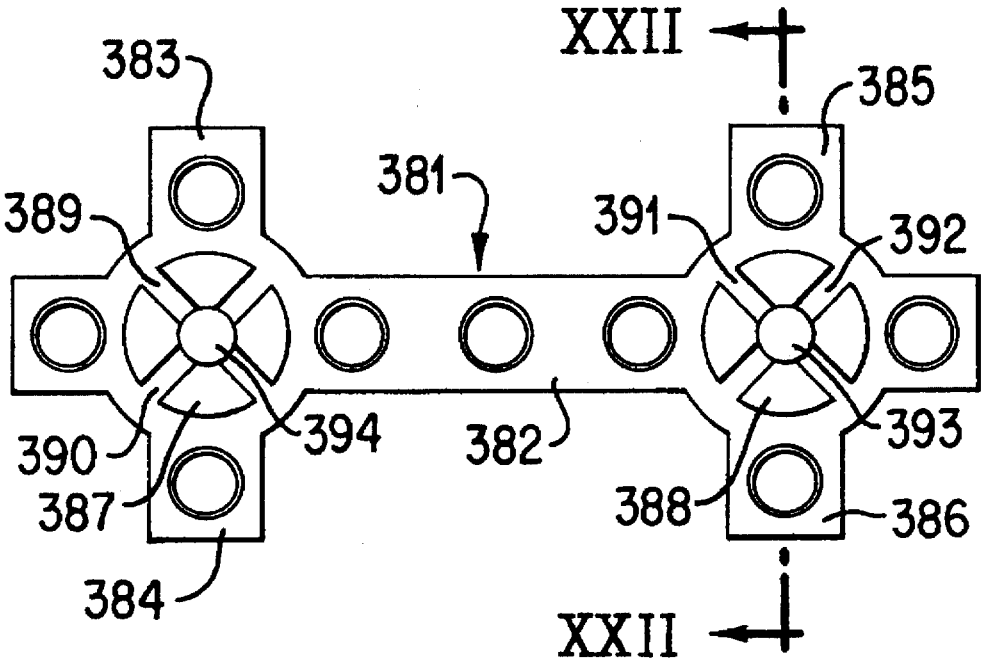
FIG. 22 a representation of a coupling element.
Figure 23:
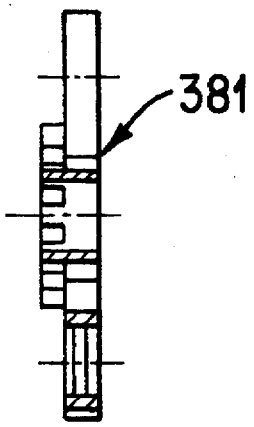
FIG. 23 a representation partly in cross-section according to the line XXII—XXII of the coupling element of FIG. 22.

A first construction of such a connecting element is shown in FIGS. 22 and 23. The connecting element 381 comprises a metal plate 382 having a length equal to the width of the grooves 39 and 45 respectively. Perpendicular to the longitudinal direction of the plate 382 and corresponding to the grooves 38 and 44 additional portions 383,384, 385 and 386 are provided on both sides of the plate 382. The dimensions are such that the distances of the intersections of the axis to the free ends are mutually equal. Around each intersection and on the plate 382 there is provided a projection 387, 388. Each projection 387 and 388 respectively consists practically out of four projections having the shape of a circle sector, which four projections being separated from each other by channels 389, 390, 391 and 392. At the intersection of the axis there are provided in the plate 382 two bores 393 and 394. Further bores are provided in the plate 382 and the additional portions 383, 384, 385 and 386 corresponding to the bores 70, 71, 73, 72, 106, 74, 75, 77, and 76 in the volume part.

Figure 24:
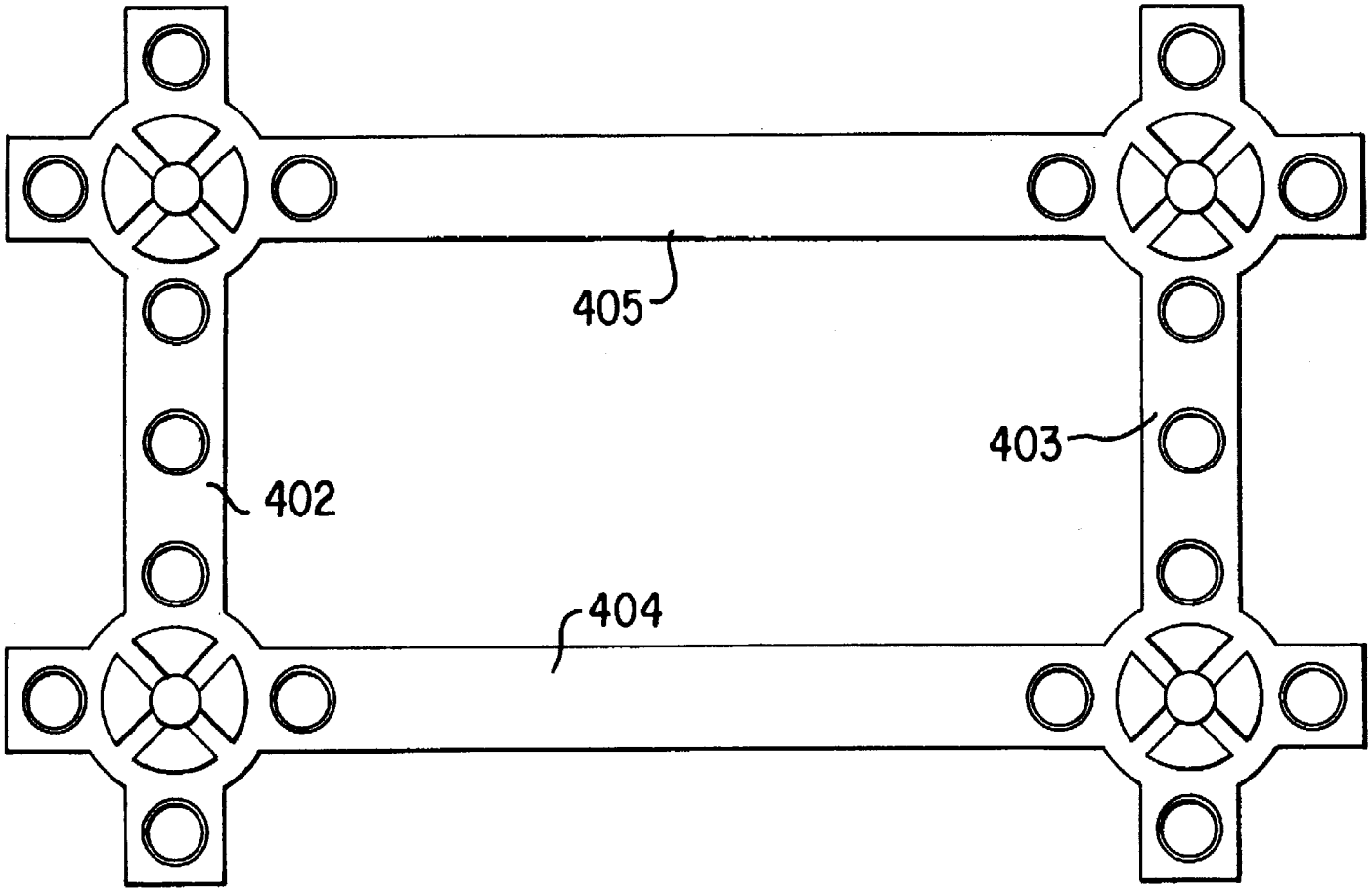
FIG. 24 a representation of a coupling element which has been modified with respect to the coupling element according to FIG. 22.

The coupling elements shown FIG. 24 can be regarded as being composed of two parts 402 and 403, both being identical to an auxiliary member 381, two additional portions located at the same side of each part 402 being connected to two additional portions located at the same side of the other part 403 by means of plate members 405 and 404.

In use the coupling elements can be accommodated in the grooves of the outer surface of the volume elements, whereupon in one of the channels of each of the projections 387 or 388 one end of a pull bar can be accommodated, whereas the other end is accommodated in a channel in another projection, whereby a pull force can be generated in diagonal direction in order to keep the different buildings units together.

In FIG. 25 there is shown how the different parts described above in great details are cooperating so as to come to a modular composition of buildings units. The reference numerals in this figure correspond to the above used reference numerals and the drawing as such is self-explanatory for the man skilled in the art.

Figure 26:
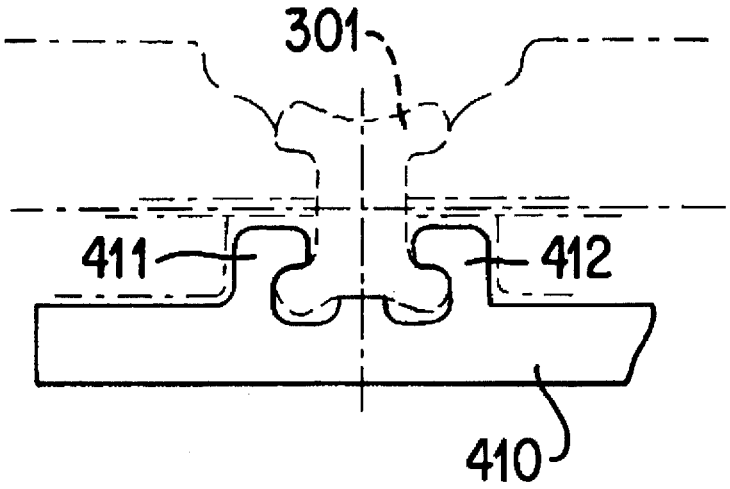
FIG. 26 a schematic representation of the way of coupling between a decoration plate and the composition obtained by building units according to the invention.

More especially in this Figure there is shown how by a suitable shape of the coupling element 350 and the volume element 10 a system has been obtained for mounting decoration panels or the like. As already shown in FIG. 14 the element 350 is provided with a recess 357 corresponding to the recess 316 in the coupling element 301. In the volume elements the cross surfaces are provided with rectangular recesses 150, 151, located at half the height of the volume element and further corresponding to the recesses 261,263 in the support element 200. The height of the recess 316 or 357 is equal to half the height of the recess 150, 151, the recess extending from halfway the height upwardly. In FIG. 26 there is shown that a decoration panel 410 at its rear side is provided with two L-shaped lips 411 and 412, having a height equal to the height of the recess 316 or 357. These lips 411 and 412 together form a guiding fitting over the plate like members 303 or 304 of the coupling element 301 or corresponding members 351,352. In this way the lips 411 and 412 of the decoration panel can be inserted in the recess 316 or 357 and thereupon the decoration panel can slide downwardly along the plate like member until it rests on the under side of the recess 150. By a suitable choice of the position of the lips 411, 412 a decoration panel can be fixed by one movement at different places to the construction obtained by means of the building units according to the invention. It is obvious that this construction is not restricted to the fixation of decoration panels, but that different other implements can be connected to the building unit in this way.

It is also clear that the invention is not restricted to the construction shown and/or described, but that within the scope of the annexed claims different modifications may be applied. More especially, it is possible to substitute the recesses in the volume element by projections and vice versa, as far as a consistent building unit is obtained thereby. Furthermore it is possible to substitute the ribs by grooves and vice versa, and multiple modifications can be applied in the shape and the nature of the support element, coupling element and connecting element without departure from the inventive concept. Accordingly, while presently preferred embodiments of the invention have been shown in particularity, it may be otherwise embodied within the scope of the appended claims.

I claim:

1. A composite building unit comprising at least one volume element having an upper surface with at least one projection and a bottom surface with at least one cavity positioned and configured to accommodate a projection from another volume element and at least one support element substantially perpendicular to said upper and bottom surface of said volume element, wherein said volume element is provided with at least one channel extending from said upper surface to said bottom surface and said support element is connected to said volume element at said channel.

2. A composite building unit according to claim 1 wherein said channel is rectangular and said support element comprises a substantially rectangular plate extending from said upper surface to said bottom surface of said volume element.

3. A composite building unit according to claim 2 wherein said support element has an edge shape substantially the same as said upper surface of said volume element and an opposite edge having a shape substantially same as said bottom surface of said volume element.

4. A composite building unit according to claim 1, wherein said upper surface of said volume element is provided with a plurality of projections located equal distance from each other along a line parallel to a common longitudinal edge of said upper surface and wherein said cavities in said bottom surface are correspondingly positioned.

5. A composite building unit according to claim 4 wherein said upper surface is provided with projections located along two parallel lines which at the same time are also parallel to a common edge of said upper surface and a longitudinal surface, the distance between each pair of adjacent projections located on a same line being equal to the distance between two adjacent projections on different lines, and in that the cavities in said bottom surface are positioned to correspond to said projections.

6. A composite building unit according to claim 5 wherein there are two or four projections on each line.

7. A composite building unit according to claim 6 wherein the distance between said upper surface and said bottom surface is equal to the distance between two projections or a multiple thereof.

8. A composite building unit according claim 1 including two identical volume elements each of substantially a rectangular configuration and each having a tangent plane substantially perpendicular to said upper and bottom surface.

9. A composite building unit according to claim 8 wherein said tangent plane of each volume element is provided with grooves having semi-circular cross-section and extending from said upper surface to said bottom surface.

10. A composite building unit according to claim 8 or 9 wherein said tangent plane of each volume element is provided with kams.

11. A composite building unit according to claim 8 wherein bores are provided in said tangent plane for connecting said volume elements to each other.

12. A composite building unit according to claim 1 or 8 wherein said support element is interposed between two said volume elements.

13. A composite building unit according to claim 1 wherein said upper surface of said volume element is provided with a plurality of projections located equal distance from each other along a line parallel to a common longitudinal edge of said upper surface and wherein said cavities in said bottom surface are correspondingly positioned.

14. A composite building unit according to claim 13 wherein said upper surface is provided with projections located along two parallel lines which at the same time are also parallel to a common edge of said upper surface and a longitudinal surface, the distance between each pair of adjacent projections located on a same line being equal to the distance between two adjacent projections on different lines, and in that the cavities in said bottom surface are positioned to correspond to said projections.

15. A composite building unit according to claim 14 wherein there are two or four projections on each line.

16. A composite building unit according to claim 15 wherein the distance between said upper surface and said bottom surface is equal to the distance between two projections or a multiple thereof.

* * * * *

UNITED STATES PATENT AND TRADEMARK OFFICE

CERTIFICATE OF CORRECTION

PATENT NO. : 5,687,530

DATED : November 18, 1997

INVENTOR(S) : VAN DER HEIJDEN, Franciscus Anthonius Maria

It is certified that error appears in the above-identified patent and that said Letters Patent is hereby corrected as shown below:

In Column 9, line 39 ,the phrase "in coupling element 350" should be added after the number "352"

In Column 4, line 23, the word "cams" should be changed to "kams"

In Column 4, line 27, the word "cams" should be changed to "kams"

In Column 4, line 28, the word "cams" should be changed to "kams"

In Column 5, line 9, the word "cams" should be changed to "kams"

Signed and Sealed this

Seventh Day of July, 1998

Bruce Lehman

*Attest:*

BRUCE LEHMAN

*Attesting Officer*

*Commissioner of Patents and Trademarks*